US005624327A

United States Patent [19]

Smith

[11] Patent Number: 5,624,327

[45] Date of Patent: Apr. 29, 1997

[54] ELECTRONIC GOLF PRACTICE DEVICE

[76] Inventor: Martin O. Smith, 146 Ard Easmuinn, Dundalk Co. Louth, Ireland

[21] Appl. No.: 244,587

[22] PCT Filed: Dec. 2, 1992

[86] PCT No.: PCT/IE92/00025

§ 371 Date: Oct. 21, 1994

§ 102(e) Date: Oct. 21, 1994

[87] PCT Pub. No.: WO93/10867

PCT Pub. Date: Jun. 10, 1993

[30] Foreign Application Priority Data

Dec. 4, 1991 [IE] Ireland ..... 4204/91

[51] Int. Cl.[6] ..... A63B 69/36

[52] U.S. Cl. ..... 473/268

[58] Field of Search ..... 273/35 R, 183.1, 273/186.1, 187.1, 187.6, 192, 195 R, 35 A

[56] References Cited

U.S. PATENT DOCUMENTS

| | | | |
|---|---|---|---|
| 3,992,011 | 11/1976 | Jessee | 273/187.6 X |
| 4,765,625 | 8/1988 | Miner | 273/187.1 |
| 4,786,057 | 11/1988 | Brown | 273/186 R |
| 4,963,314 | 10/1990 | Gering et al. | 273/187.6 X |
| 4,979,745 | 12/1990 | Kobayashi | 273/183.1 X |
| 5,042,814 | 8/1991 | Bennett | 273/183 A |

FOREIGN PATENT DOCUMENTS

| | | | |
|---|---|---|---|
| 599118 | 6/1994 | European Pat. Off. | 273/183.1 |

*Primary Examiner*—William E. Stoll

*Attorney, Agent, or Firm*—William C. Gerstenzang; Sprung Horn Kramer & Woods

[57] ABSTRACT

A golf putting practice device which provides visual feedback to the user, comprising a head position indicator, visible only when the user's head is in the correct position while striking a golf ball, and which changes color to indicate when the user may move his or her head, and a device for determining that the putter has been maintained in the proper position relative to the ground surface.

8 Claims, 2 Drawing Sheets

ELECTRONIC GOLF PRACTICE DEVICE

The invention relates to a golf practice device which actively promotes adherence to the recognised fundamentals of the game and trains the player to develop the high degree of concentration, or focus, necessary in order to perform to the maximum of his potential.

BACKGROUND OF THE INVENTION

In this embodiment, the device refers to the act of putting, which act is not influenced by the level of athleticism of the participant but rather by his adherence to the fundamentals, coupled with the attainment of a level of concentration such as to preclude any conscious thought not related to the act in hand e.g., the consequences of missing, memories of past failures, etc.

Most short putts—of two meters or less, are missed, either because the player does not conform to recognised fundamentals or because he is not focused on the task, to the exculsion of all irrelevancies, rather than because of any lack of capalility.

It is generally accepted by golfers that a good swing is the result of the successful merging of two distinct phases, which are (i) the static phase and (ii) the dynamic phase. In order to develop a competent swing, there are fundamentals which must be applied to each phase.

The static phase of the swing, i.e., grip, set-up, stance, posture can be learned and mastered. This area is already well provided for by books, videos, practice devices etc. However, unless the player adopts a set-up position such as to place his eyes directly over the intended line of putt he will not have the correct perspective to judge the shot accurately. The invention sets the player in this position and the device can not be properly used until this position is adopted.

The dynamic phase of the swing—the actual swinging of the club—is governed by so many variables e.g., height, build, athleticism etc. that no two swings can be the same. Further, the number and complexity of the various movements required to execute the swing are such that they cannot be successfully controlled or executed by the conscious part of the brain. These movements, as is the case with all physical acts, can and must be controlled by the sub-conscious.

This invention identifies the need for, and provides the user with, a focus so specific as to preclude all 'conscious' control whilst ensuring that he comply with the fundamentals of the dynamic phase, which are (i) A fixed (steady) head position maintained through, and beyond, contact with the ball.

(ii) Minimum lateral movement of the body around the axis established by the fixed head position.

(iii) A smooth free swing, through the ball, rather than a hit at the ball.

(iv) A putter-head maintained close to and parallel to the ground for a distance determined by compliance with (i) above.

There is a golf truism that holds that the handicap golfer would immediately improve his shot-making if he were to apply his practice swing to the actual shot. However, as such practice swings are usually taken without the presence of a ball, there is, obviously, no visual feedback to indicate compliance with any or all of the fundamentals. The invention provides this feedback, whether or not a ball is being used. This invention provides visual evidence to the user of any lateral body movement throughout the complete swing.

DISCUSSION OF PRIOR ART

Devices are known which assist the golfer in the static phase of the swing, e.g., foot position indicators, club-head alignment indicators. Devices are known which, in use, train the user to acquire conscious control of the movement of the club. No device is known which encourages sub-conscious control of the physical action while at the same time ensuring compliance with the recognised fundamentals, by providing a specific active focus which precludes conscious interference, thus allowing the user to learn 'naturally'.

This devise is used to help golfers to acquire and maintain a correct position directly over the ball, maintain this original position throughout, acquire the ability to maintain the putter-head close to and parallel to the ground during the execution of the shot, and to develop the mental discipline necessary to ensure that no outside factors, e.g., anxiety, fear, attempts at conscious control etc., impinge on the task at hand. It is precisely such anxieties, coupled with the attempt to consciously control the action, which leads to the involuntary muscle spasm known as the "yips". This affliction has terminated many successful golfing careers. This invention reduces the possibility of any such occurrence.

DETAILED DESCRIPTION

Physically the device consists of a flat plate, approx. 35 cm by 17 cm, by 12 mm thick, tapered at both ends to allow a ball to be rolled freely on or off the plate. There is a raised rectangular pod along one side to accommodate the electronic circuitry.

In use, the ball is placed in a small locating depression on the surface of the device and a narrow beam of light is projected upward from immediately behind it. This beam can only be seen when the eyes are positioned within 2 cm of the beam centre. The narrow light beam used to help the user position his head is generated using a tricolour light emitting diode as the light source. This has the advantage of permitting beam colour change to be used as a signal to the user when it is permissible for him to move his head after the stroke. An important property of the beam is that at head level it must be narrower than the distance between the pupils of the user's eyes, so as to ensure that there is no ambiguity about the correct head positioning with respect to the ball. This narrowness is achieved by using two small apertures (each about 1 mm in diameter) to confine and define the beam. The first aperture is immediately adjacent to the light source, and permits light to shine along a narrow horizontal tunnel underneath the putting surface. A small mirror mounted at the end of this tunnel turns the beam through ninety degrees so that it shines vertically upwards through the second aperture, which is in the putting surface immediately behind the ball. Aperture size was chosen to be as large as possible, consistent with meeting the restriction on beam diameter at eye level, in order to maximise the preceived brightness without using excessive battery power. Increasing the distance between the two apertures permits them to be proportionately (to a first approximation) larger, for a given beam diameter at eye level, and the selection of light source and first aperture position with respect to the second aperture position behind the ball was made with a view to making the inter-aperture distance as large as convenient within the confines of the unit without having to use multiple reflection.

When his head is correctly positioned the user perceives the second aperture as a small bright disc (approx 1 mm in diameter) between the ball and the face of the putter. He or she is required to use a particular eye (e.g. right or left eye)

with any particular unit setting. The angle of the beam can be adjusted slightly by repositioning the light source and first aperture, or by altering the angle of the mirror, so as to allow optimisation of the beam position for use with a particular eye.

The mirror used can be conventional or prismatic. In the latter case the beam enters the prism at right angles to one face, is internally reflected off a second (longer) face, and exits at right angles to the third face of the prism. The prism would have two forty five degree angles and one ninety degree angle, giving two equal short faces at ninety degrees to each other, each being at forty five degrees with respect to the third, longer face.

The presence of the ball is detected using infra-red pulse reflection. When the ball is struck and the putter has passed beyond the infra-red detection zone the light beam remains unchanged for about a half second, then changes colour for one second to indicate to the golfer that it is safe to move, thus ensuring that the head position has not changed and that the swing has been smooth throughout. The degree of concentration necessary to achieve this ensures that there can be no 'conscious' interference during the execution of the shot. The device may be used with or without a ball, as the criterion for the delayed transition from one colour to the other is the presence of a detected object in the infra-red detection zone followed by its absence. This zone is designed to exclude the rest position of the putter prior to putting, so in the no-ball case the change of colour in the light beam is triggered by detection of the putter as it passes through the detection area during the stroke, followed by detection of its absence.

A small captive roller in a slot directly behind the ball where the sloped and flat sections meet protrudes circa 2 mm above the flat surface. This serves as an indicator that the putter was kept suitably low during the backswing, by being knocked into a recessed part of the slot so that the top of the roller is at or below the flat surface level, on completion of the back swing and does not interfere with the forward swing. This provides a visual confirmation of compliance with this fundamental.

With the exception of the battery and switch all electrical components are mounted on a small printed circuit board.

The beam is generated using a tricolour light emitting diode shing through two small apertures approximately 12 cm apart. One of these is near the light emitting diode and the other is positioned where the beam exits from the body of the unit. A mirror is used to deflect the beam through 90 degrees prior to its leaving the unit.

The invention will now be described by way of example only with reference to the accompanying drawings in which.

Figure 1:
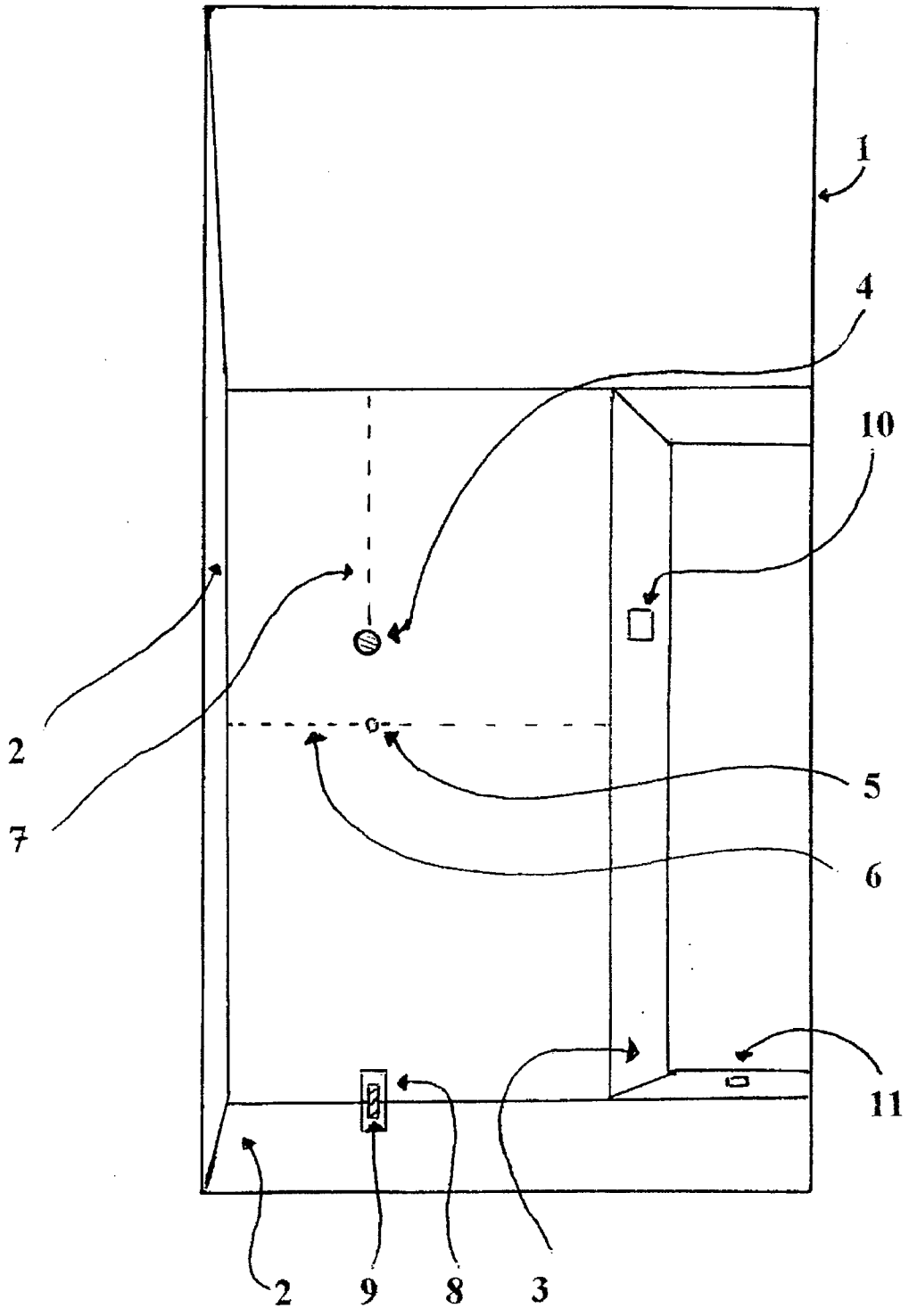
FIG. 1 is a plan view of the invention

Referring to FIG. 1, there is shown generally at 1 the device according to the invention comprising a base piece 35 cm by 17 cm by 12 mm thick, manufacted from plastic on other suitable durable material, the surface of which is covered with a material textured sufficiently to provide friction in order to generate roll on the ball after it has been struck, tapered at both ends 2 with a raised rectangular pod along one side to accommodate the elctronic circuitry. There is a ball locating depression 4 on the surface positioned in proximity to the head position indicator 5 which is in the form of an aperture through which passes a narrow light beam. There is a line 6 drawn on the surface, to ensure correct positioning of the putter-head in relation to the target line 7.

Directly behind the light beam aperture, at the point where the surface tapers there is located a small captive roller 8 which, with a correctly executed backswing, is brushed into a recessed slot 9 so as to then be below the surface and so as to not interfere with the forward stroke. This captive roller is then replaced by the user in its original position on the surface, as required.

Figure 2:
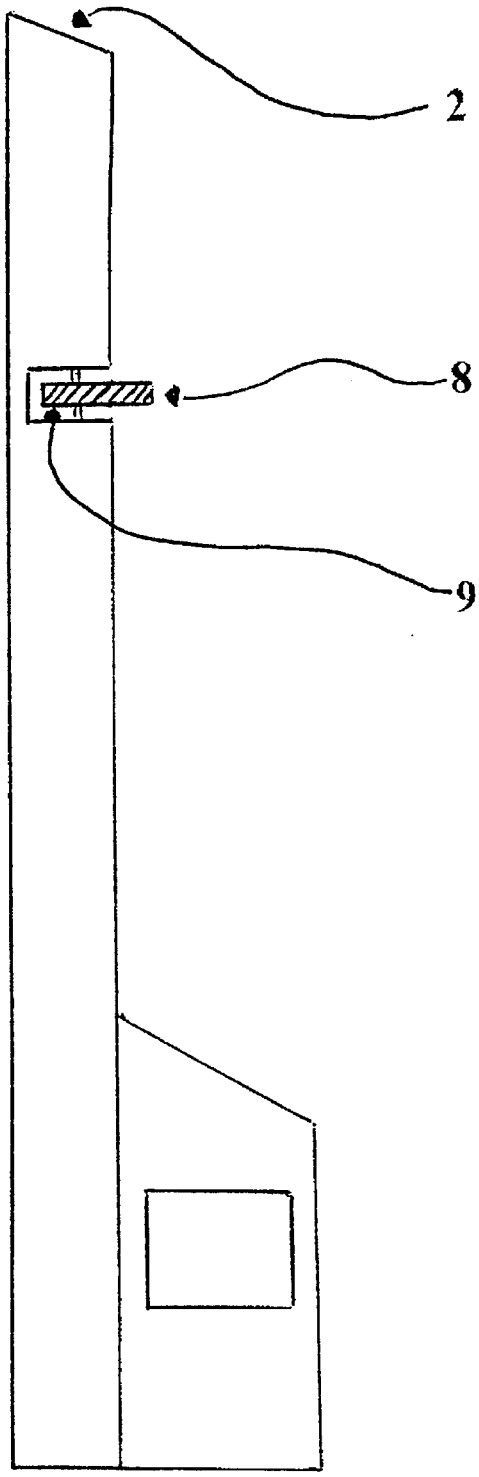
FIG. 2 is a rear elevation.

An infra-red beam is emitted through the aperture 10 which detects the presence of the ball or the putter in the infra-red zone followed by its absence. When the ball is struck the light beam maintains its colour for approx. 5 secs. before changing to a different colour, thus ensuring that the correct head position is maintained beyond impact. The on/off switch 11 is loaded to the side of the raised pod. Power is provided by a single 9 volt dry battery located in pod 3. FIG. 2 shows the location of the recess slot 9 for the captive roller 8 located on the tapered end 2 of the device.

Physically the device consists of a flat plate, approx. 35 cm by 17 cm, by 12 mm thick, tapered at both ends to allow a ball to be rolled freely on or off the plate. There is a raised rectangular pod along one side to accommodate the electronic circuitry. With the exception of the battery and switch, all of the electrical components are mounted on a small printed circuit board (PCB) and contained within this pod.

In use, the ball is placed in a small locating depression on the surface of the device and a narrow beam of light is projected upward from immediately behind it. The light beam is generated using a tricolour light emitting diode shining through two small apertures approximately 12 cm apart. One of these is near the light emitting diode and the other is positioned where the beam exits from the body of the unit. A mirror is used to deflect the beam through 90 degrees prior to its leaving the unit. This beam can only be seen when the eyes are positioned within 2 cm of the beam centre. The narrow light beam used to help the user position his head is generated using a tri-colour, light-emitting diode as the light source. This has the advantage of permitting beam colour change to be used as a signal to the user when it is permissible for him to move his head after the stroke. An important property of the beam is that, at head level, it must be narrower than than the distance between the pupils of the user's eyes, so as to ensure that there is no ambiguity about the correct head positioning with respect to the ball. This narrowness is achieved by using two small apertures (each about 1 mm in diameter) to confine and define the beam.

The first aperture is immedialty adjacent to the light source, and permits light to shine along a narrow horizontal tunnel underneath the putting surface. A small mirror mounted at the end of this tunnel turns the beam though ninety degrees so that it shines vertically upwards through the second aperture, which is on the putting surface immediately behind the ball. Aperture size was chosen to be as large as possible, consistent with meeting the restriction on beam diameter at eye level, in order maximise the perceived brightness without using excessive battery power. Increasing the distance between the two apertures permits them to be proportionately ( to a first approximation) larger for a given beam diameter at eye level, and the selection of light source and first aperture position with respect to the second aperture position behind the ball, was made with a view to making the inter-aperture distance as large as convenient, within the confines of the unit, without having to use multiple reflection.

When the user's head is correctly positioned ,the user perceives the second aperture as a small bright disc (approx.

1 mm in diameter) between the ball and the face of the putter. He/she is required to use a particular eye (e.g. right or left eye) with any particular unit setting.

The angle of the beam can be adjusted slightly by re-positioning the light source and first aperture, or by altering the angle of the mirror, so as to allow optimisation of the beam position for use with a particular eye.

Another method of positioning the user's head, is a three-dimensional fitting, located in the same position relative to the ball-locating depression as the aperture for the beam. This three-dimensional fitting would consist of a number of indicia, positioned one directly above the other, so that the lower indicia would not be visible when the user is in position with the eyes directly above the indicia and would become visible only by changing the viewing perspective, i.e., by moving the position of the head. Any lateral movement during the swing would alter this perspective, thereby making the lower indicia become visible to the user. The indicia would be located so that the uppermost one would be flush with the surface of the device, in order to ensure that it would not impede the movement of the club.

The mirror used to deflect the beam can be conventional or prismatic. In the latter case the beam enters the prism at right angles to one face, is internally reflected off a second (longer) face, and exits at right angles to the third face of the prism. The prism would have two forty five degree angles and one ninety degree angle, giving two equal shod faces at ninety degrees to each other, each being at forty five degrees with respect to the third, longer face.

The presence or absence of the ball is detected using infra-red pulse reflection. An infra-red detection system, followed by a logic and timing circuit is used to sense the presence of the ball or the putter head. This system controls the colour of the light beam which changes from red to green, for a short period, shortly after the putter head passes through the area where the ball is placed. It is this change of colour that indicates to the user that he has rtemained in the correct position through to completion of the stroke. In operation, Infra red radiation is generated by an emitter and is radiated out through the aperture. This infra red may be continuous or consist of a stream of short pulses in order to conserve battery power. In this embodiment, it consists of a stream of short pulses. Any object placed in front of the aperturer reflects a portion of this infra red radiation back through the aperture onto an infra red detector. The aperture contains an infra red filtering material to reduce undesired effects that might result from detection of ambient light. The peak level of the resulting electrical signal is detected and compared with a reference level by a circuit having a binary output signal indicating the presence or absence of a reflecting object outside the aperture. The reference level is chosen such that a ball placed in front of the aperture, or a putter head passing in front of it, will be detected, but objects that are further away—such as the users clothing or shoes—are not detected. As long as an object is being detected, the output of this circuit will remain in one of its two possible states, and once the object is no longer detected the output changes to the other possible state.

This binary signal is connected to a time delay/circuit which , in turn, drives a binary comparator.

The effect of this arrangement is that on removal of the detected object from in front of the aperture, the resulting state change at the output of the first comparator is followed , approximately half a second later, by a state change at the output of another comparator. This delay is used to ensure that the light beam that the user is watching does not change from red to green until half a second after the removal of the detected object.

This time-delayed signal is then fed to a differentiator circuit, which generates a narrow trigger pulse of a particular polarity, when the time-delayed binary signal changes from a 'ball detected' state to a 'nothing detected' state. This trigger pulse is then fed to the input of a one-shot (univibrator) circuit, causing it to generate a pulse approximately one second long and then return to its original state until another trigger pulse occurs.

This one second pulse is used to control the currents fed to a multi-coloured light-emitting diode, in such a way that it emits red light when the univibrator is not pulsing, and green light for the duration of the one second pulse only.

Because the univibrator is only triggered when an object is removed from in front of the aperture the normal colour of this light is red, whether an object is detected or not, except for the period extending from half a second to a second and a half immediately/following the removal of the detected object from in front of the aperture.

When the device is used with a golf ball the ball is detected prior to the stroke, and consitutes a detected object. Once the ball is moved from in front of the aperture-there is no longer an object to detect, so the desired transition is detected and causes a delayed green light pulse.

When the device is used without a golf ball the putter itself is detected as it passes in front of the aperture, and when is has passed by, its removal causes the desired transition from "object detected" to "nothing detected" and a delayed green light pulse results.

Transitions from "nothing detected" to "object detected" do not trigger the univibrator, because such transitions doe not produce trigger pulses with the correct polarity at its input. Consequently these transitons do not cause any change in the colour of the light emitted from the multi coloured light emitting diode.

Another means of detecting the presence or absence of the ball is a pressure sensor directly under the ball-location depression, connected, via a simple electronic circuit, to the light emitting diode. On detecting any change in pressure, brought about by the presence or absence of the ball, the sensor would transmit a signal to the light-emitting diode, causing a change in colour.

An alterative means of signalling to the user that it is permissible to move his head is an audible signal electronically produced and triggered, through the infra red detector, on a timed basis, on completion of the stroke.

A small, captive roller is located in a slot directly behind the ball where the sloped and flat sections meet and protrudes approximately 2 mm above the flat surface. This serves as an indicator that the putter was kept suitably low during the backswing, by being knocked into a recessed part of the slot so that the top of the roller is at or below the flat surface level on completion of the back swing and does not then interfere with the forward swing. This provides a visual confirmation of compliance with this fundamental.

Another means to ensure that the head of the putter is kept close to the surface of the device, in the initial stage of the back-swing, is by means of an infra-red being transmitted along the surface of the device and bisecting the backwards path of the club-head. This means replicates the infra-red emission/detection system used in the ball detection. The action of the club-head through the beam triggers an indicia which would be located the surface of the device in such position as to be readily visible to the user on completion of the stroke, but positioned so as not to cause any distraction during the actual execution of the stroke.

With the exception of the battery and switch all electrical components are mounted on a small printed circuit board, which is contained within the raised pod.

While the device described above is the preferred embodiment, the invention is not limited to this precice description and changes may be made to the device without departing from the scope of the invention, as defined in the following claims.

I claim:

1. A golf practice device for training a golfer to develop the degree of concentration necessary for successful putting comprising a base piece for positioning on the ground at a locus appropriate to the users feet, a ball position locating depression located on the surface of said base piece in order to accurately position a ball in relation to a head position indicator also located on said surface, said indicator being visible only when the user's head is in and remains in the correct position throughout the stroke until the appropriate interval after the ball has been struck, at which point said indicator, consisting of a narrow beam of light visible only when the correct position is adopted and maintained, changes in color to indicate to the user that he is free to move his head, and means for determining that the putter has been maintained close to the surface at the initial stage of the backswing consisting of a captive roller protruding above the surface which, when touched, rolls into a slot located on a tapered edge below the flat surface, thereby, ensuring non-interference with the forward swing, and an infra-red emittor- detector located on a raised pod to detect the presence of a ball or putter followed by its absence, which absence triggers the change in color of the head position indicator.

2. A device according to claim 1, wherein the means to detect the presence of the ball and club, followed by their absence, is a mechanical or pressure switch.

3. A device as claimed in claims 1 or 2, wherein the head position indicator is in the form of a three-dimensional fitting on or below the surface of the device.

4. A device as claimed in claims 1, 2 or 3, wherein the means for determining that the club head has been maintained close to the surface is in the form of either infra-red or photoelectric detection.

5. A device as claimed in claims 1, 2, 3 or 4, wherein the means to indicate that the player is free to move his head is an audible signal.

6. A golf practice device in accordance with claim 1, wherein said visual head indicator is in the form of a narrow beam of light, visible through an aperture on the surface of the device, with an infra-red emittor-detector located on the device such as to locate the position of the ball or club followed by their absence, when the ball and/or club are placed in proximity to rather than on the device, and a means for indicating to the user that he is free to move his head, said means being a change in color of the head position indicator.

7. A device as claimed in claim 6, wherein the means to detect the presence of the ball and club, followed by their absence, is a mechanical or pressure switch.

8. A device as claimed in claims 6 or 7, wherein the head position indicator is in the form of a three-dimensional fitting on or below the surface of the device.

* * * * *